United States Patent [19]

Marason, Jr. et al.

[11] Patent Number: 4,655,723

[45] Date of Patent: Apr. 7, 1987

[54] CHILD'S ACTIVITY RING TOY

[75] Inventors: Gabriel Marason, Jr., Los Angeles; James S. Templeton, Rancho Palos Verdes, both of Calif.

[73] Assignee: Mattel, Inc., Hawthorne, Calif.

[21] Appl. No.: 713,140

[22] Filed: Mar. 18, 1985

[51] Int. Cl.[4] ..... A63H 15/00; A63H 33/00

[52] U.S. Cl. ..... 446/241; 446/269; 446/421; 446/489; 411/385; 411/417

[58] Field of Search ..... 446/227, 241, 256, 269, 446/270, 279, 289, 409, 421, 418, 419, 431, 489, 491, 104, 490, 297; 411/417, 385; D21/63, 65

[56] References Cited

U.S. PATENT DOCUMENTS

| | | | |
|---|---|---|---|
| D. 277,585 | 2/1985 | Tapdrup . | |
| D. 279,491 | 7/1985 | Tell . | |
| 616,244 | 12/1898 | Meyer | 446/241 |
| 804,907 | 11/1905 | Whitfield | 446/247 |
| 1,756,608 | 4/1930 | Reider | 272/31 R |
| 2,211,102 | 8/1940 | Davis | 446/419 |
| 2,282,881 | 5/1942 | Ostrow | 446/227 |
| 2,326,394 | 8/1943 | Richey | 411/417 X |
| 2,799,587 | 7/1957 | Schwartz | 446/104 |
| 2,817,184 | 12/1957 | Inouye | 446/489 |
| 2,920,418 | 1/1960 | Britt | 446/241 |
| 2,961,796 | 11/1960 | Davis | 446/489 X |
| 3,078,614 | 2/1963 | Fors et al. | 446/489 |
| 3,713,251 | 1/1973 | Marason, Jr. | 446/241 |
| 3,922,946 | 12/1973 | Grayson | 411/385 |
| 4,334,382 | 6/1982 | Chase et al. | 446/490 |
| 4,381,620 | 5/1983 | Panzarella | 446/236 X |

FOREIGN PATENT DOCUMENTS

| | | | |
|---|---|---|---|
| 1027937 | 2/1953 | France | 446/227 |
| 317404 | 8/1929 | United Kingdom | 446/240 |

OTHER PUBLICATIONS

Catalog, "Creative Playthings/1969-70", Space Rings (TM) Teether, p. 5.

"Toys to Grow On" TM, Sales Literature, P.O. Box #17, Long Beach, CA 90801, 1982.

*Primary Examiner*—Robert A. Hafer

*Assistant Examiner*—Terrence L. B. Brown

*Attorney, Agent, or Firm*—Ronald M. Goldman; Melvin A. Klein; John Mesaros

[57] ABSTRACT

A child's activity ring toy having first and second concentric ring portions, at least a part of at least one of the ring portions having thread segments along a multiple screw path with adjacent thread segments of adjacent screw paths overlapping in the axial direction. A figure is mounted on this threaded part of the ring with an opening therein configured for engaging a next thread segment in the axial direction as a previous thread segment is disengaged.

9 Claims, 9 Drawing Figures

10
12
12a
12b
14
16
18
20
22
24
30
30a
30b
32
32a
33
34
35
36
40
40a
42
46
48
61
2
3
7
8

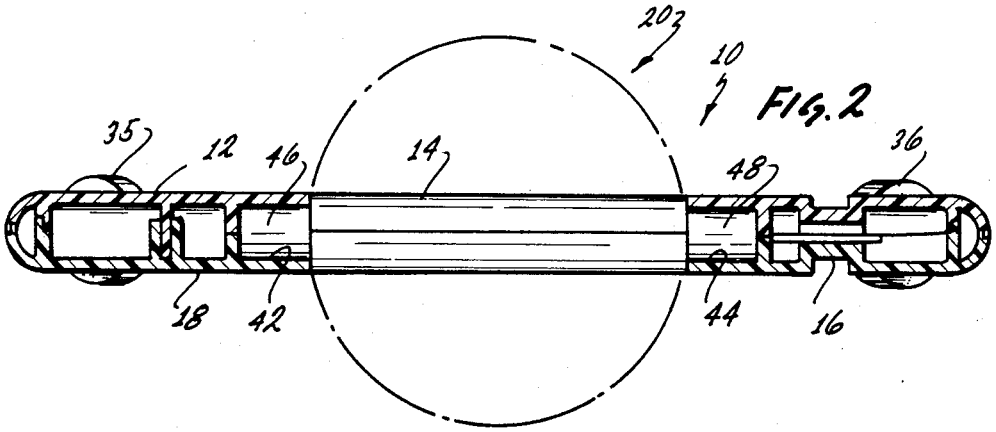
FIG. 2
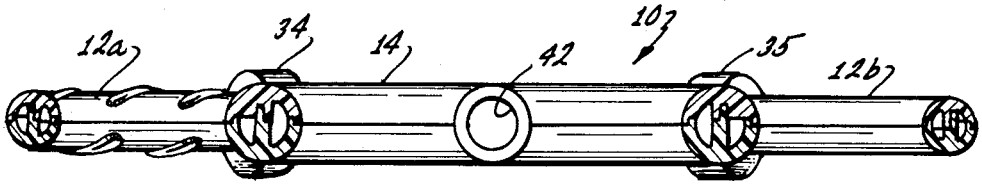
FIG. 3
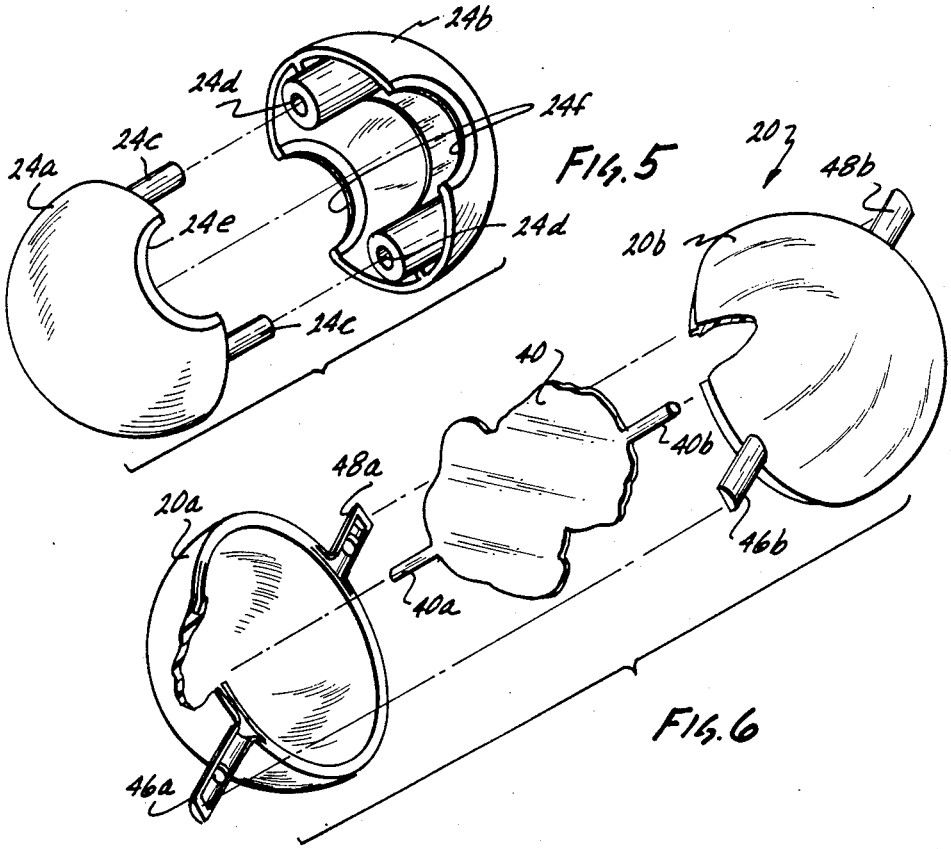
FIG. 5
FIG. 6

CHILD'S ACTIVITY RING TOY

BACKGROUND OF THE INVENTION

The background of the invention will be discussed in two parts:

1. Field of the Invention

This invention relates to children's toys, and more particularly to an activity ring toy having provision on the ring for causing rotation of a figure thereon under the force of gravity.

2. Description of the Prior Art

Toys for toddlers, or children of very tender years require some form of animation which does not necessitate a high degree of dexterity. One of the most popular of such toys is the rattle which can be gripped by the child and shaken to create a noise which provides a source of amusement.

Other toys have been configured for attachment to the crib for rotation or vibration in response to movement of the crib. Some toys have been developed for producing spiral movement of an object along a threaded shaft or line of the toy. One such toy is shown and described in U.S. Pat. No. 616,244, issued Dec. 20, 1898 to Meyer for "Game Apparatus", such device having a spiral threaded standard with a receptacle having a plurality of compartments configured for rotational descent on the standard, with provision for dropping disks into the compartments during the descent.

Another such device is shown and described in U.S. Pat. No. 1,756,608, issued Apr. 29, 1930 to Reider for "Machine for use as Mechanical Toys and Other Purposes", such device having a vertical threaded shaft engaged by a threaded block with a transverse arm having toy airplanes suspended at the ends therefof, the block and arms rotating during descent.

Another device using a threaded shaft is shown and described in U.S. Pat. No. 2,799,587, issued July 16, 1957 to Schwartz for "Children's Amusement Toy", the toy being a spiral grooved handle for a lollipop, with a tubular member coacting with the slot to produce rotation of the candy as the tubular member is moved longitudinally on the handle.

Another toy using a threaded member is shown and described in U.S. Pat. No. 2,920,418, issued Jan. 12, 1960 to Britt for "Amusement Devices". This patent discloses a device having a spiral threaded shaft with a handle affixed to each end with a wheel member rotatably supported therebetween, the wheel member engaging the spiral thread, with springs provided so that upon rotation of the shaft by manipulation with the hands, the wheel rotates and moves axially along the shaft.

A "Spin Pole Doll Accessory" is shown and described in U.S. Pat. No. 3,713,251, issued to Marason on Jan. 30, 1973, the device including a vertically extending pole with a helical thread and a doll carrier mountable on the pole for rotational movement during descent.

A device which simply uses a ring with other rings mounted thereon is shown in U.S. Pat. No. 2,817,184, issued Dec. 24, 1957 to Inouye for a "Hoop Toy", the toy including a rather large diameter closed hoop with small diameter closed rings assembled thereon, the object being to rotate the rings by manipulation of the hoop.

It is an object of the present invention to provide a new and improved toy having a threaded portion for rotation of a figure thereon.

It is another object of the present invention to provide a new and improved ring toy having activity devices assembled thereon.

It is a still further object of the present invention to provide a new and improved child's activity toy having devices assembled thereon for movement upon movement of the toy.

SUMMARY OF THE INVENTION

The foregoing and other objects are accomplished by providing an activity toy having first and second concentric ring portions, at least a part of at least one of the ring portions having thread segments along a multiple screw path with adjacent thread segments overlapping in the direction of the thread. A figure is mounted on this threaded part of the ring with provision for engaging the next thread segment as the previous thread segment is disengaged.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 2 is a cross-sectional view of the ring portion of the toy of FIG. 1, as viewed generally along line 2—2 thereof;

FIG. 3 is a cross-sectional view of the ring portion of the toy of FIG. 1, as viewed generally along line 3—3 thereof;

FIG. 5 is an exploded perspective view of another one of the activity members on the toy of FIG. 1;

FIG. 6 is an exploded perspective view of the centrally mounted ball device in the toy of FIG. 1;

DESCRIPTION OF THE PREFERRED EMBODIMENT

Figure 1:
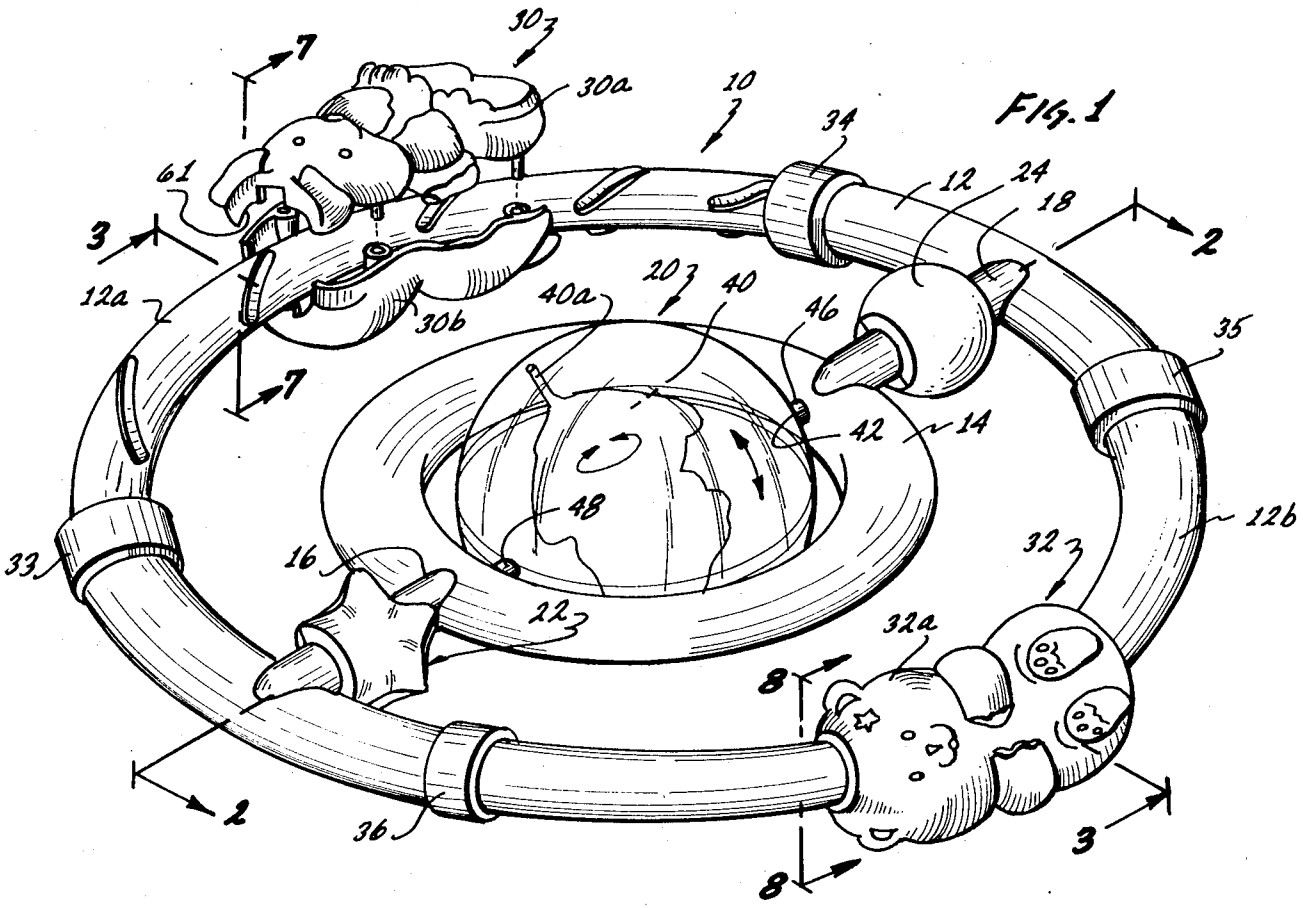
FIG. 1 is a perspective, partially exploded view of the activity ring toy according to the present invention.

Referring now to the drawings, and particularly to FIG. 1, there is shown a child's activity ring toy, generally designated 10, having a main ring assembly with an outer ring portion 12 and an inner concentric, generally coplanar ring portion 14 interconnected by radially aligned spoke portions 16 and 18, which may have equal or different diameters.

The inner ring portion 14 has a central opening sufficient for receiving therein a rotatably supported activity device such as a ball member 20. Each of the spoke portions 16 and 18 may have mounted thereon a suitable smaller activity device 22, 24, respectively, each also being capable of axial movement thereon.

On the outer ring portion 12, first and second larger activity devices, such as FIGS. 30 and 32 may be assembled thereon for movement relative thereto. As illustrated, the outer ring portion 12 is divided into several parts including first and second arcuate parts 12*a* and 12*b*, the part 12*a* is defined by annular shoulder members 33 and 34 fixed to or formed integrally with the outer ring portion 12. Similarly arcuate part 12*b* is defined by annular shoulder members 35 and 36 fixed to or formed integrally with the outer ring portion 12. As will be hereinafter described, each of the FIGS. 30 and 32 is movably mounted on the respective arcuate portion 12*a* and 12*b*.

The central ball member 20 is formed as two hemispheres, either or both of which may be transparent, with a generally planar character 40, such as an animal, positioned for rotatable movement therein.

Figure 4:
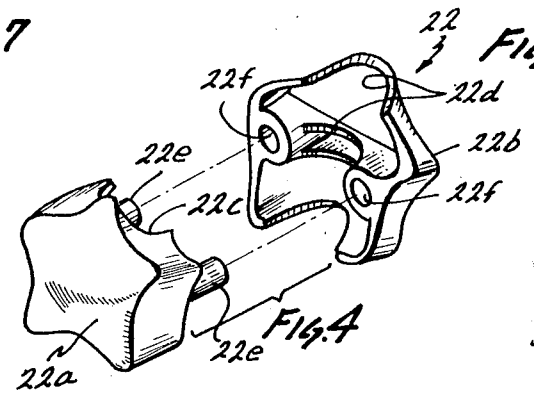
FIG. 4 is an exploded perspective view of one of the activity members on the toy of FIG. 1.

Referring to FIGS. 1, 2, 4 and 5, the activity devices 22 and 24 are formed as a star and a bead, respectively, each of which is formed of two parts or half shells with circular openings formed at the midpoints thereof for encircling the spokes 16 and 18 respectively of the ring assembly of the ring toy 10. Specifically, the star device 22, as shown in FIG. 4 is formed of two halves 22*a* and 22*b* with semicircular cutaway portions 22*c* and 22*d* formed respectively therein to form an opening, when joined together, of a diameter slightly greater than the diameter of spoke 16. As shown in FIG. 2, the spoke 16 has a reduced diameter, and with the star activity device 22 assembled thereon, both rotation about sliding along the spoke 16 is premitted. The two halves 22*a* and 22*b* are joined together by mating coacting means such as the pair of aligned projections 22*e* of half 22*a* configured for engagement within aligned openings 22*f* of half 22*b*.

The bead activity device 24, as illustrated in FIG. 5 is formed of two halves 24*a* and 24*b*, with a similar coacting pair of projections 24*c* and openings 24*d* integrally formed in the respective halves. Semicircular cutaways 24*e* and 24*f* form a circular opening of a diameter slightly greater than the diameter of the spoke 18 of the ring toy 10, thus permitting rotatable movement as well as slight axial movement thereon.

Referring now to FIGS. 1, 2 3, and 6, the ring assembly of the ring toy 10 has integrally formed journal openings 42 and 44 formed in general alignment with the spokes 16 and 18. These openings are configured for rotatably receiving therein axially aligned outwardly extending projections 46 and 48 of the ball 20. These projections 46 and 48 are formed on two halves 46*a* and 46*b*, respectively, and 48*a* and 48*b*, respectively, thus forming the axis of rotation of the ball 20 within the inner ring portion 14.

As shown in FIG. 6, the ball 20 is formed of two hemispherical halves 20*a* and 20*b*, one or both of which are preferably transparent. Assembled within the ball 20 prior to joining is a FIG. 40 which is generally planar with a pair of aligned projections 40*a* and 40*b* which form an axis having a length slightly less than the internal diameter of the ball 20, enabling off center rotation of the FIG. 40 within the ball 20 upon rotation of the ball 20 about its axis.

Figure 8:
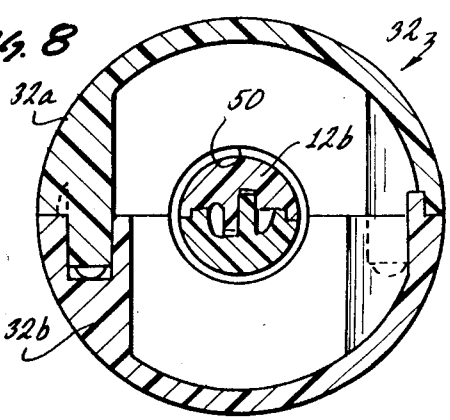
FIG. 8 is a cross-sectional view of another of the activity members of the toy of FIG. 1 as viewed generally along line 8—8 thereof.

Although not shown in detail, the activity device 32 could likewise be formed in a generally hollow configuration of two parts with longitudinally aligned openings for being received on the outer ring portion 12*b*, as shown in FIG. 1, for sliding and rotatable movement thereon. This construction is shown briefly in FIG. 8 as a cross-section of the device 32, which is formed of two halves 32*a* and 32*b* joined together by a projection and opening arrangement with aligned openings, only one of which opening 50 in the head is shown. The openings have a diameter sufficient for sliding and rotational movement on the portion 12*b* of the outer ring 12.

Referring now to FIGS. 1, 2, 3 and 7, the details pertaining to the thread configuration on portion 12*a* will be described. In molded plastic devices, particularly molded plastic devices formed of two halves joined together on a line, the formation of a continuous thread which requires coacting portions on the two halves, is difficult to reproduce on a mass production basis. Any burr, aberration or misalignement renders the thread ineffective for use with a mating threaded part.

In accordance with the present invention, the portion 12*a* of the outer ring 12 is a rod-like member which includes a plurality of thread segments which are arranged on multiple screw paths, preferably three screw paths, with each thread segment on a given screw path overlapping an adjacent thread segment on an adjacent screw path.

Figure 9:
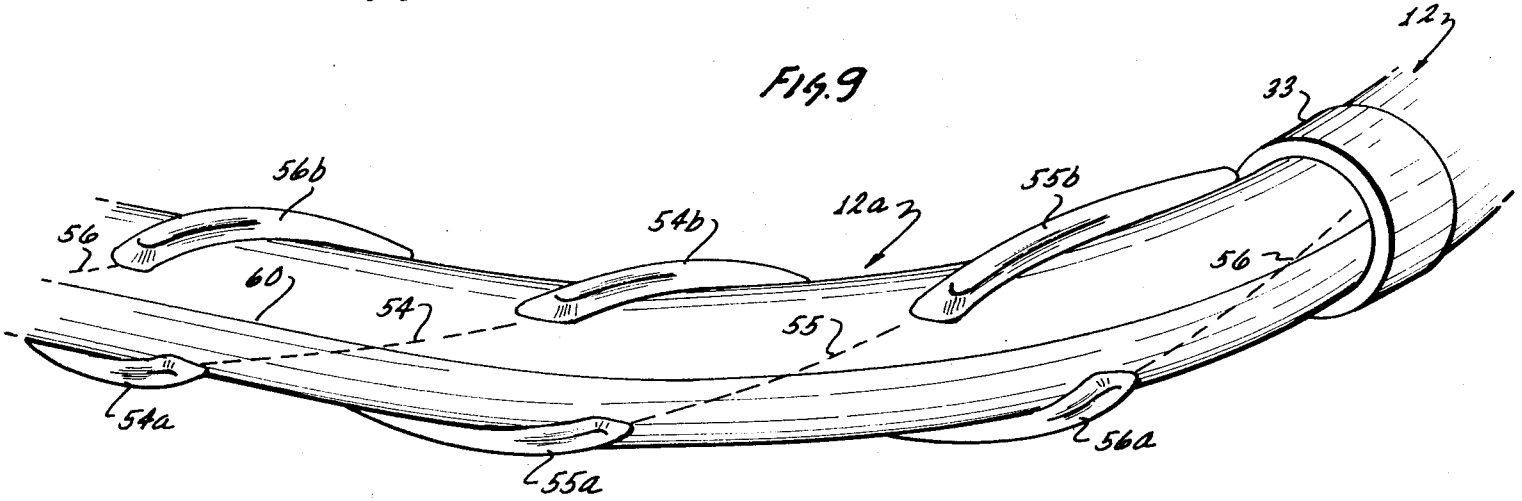
FIG. 9 is an enlarged perspective view of the threaded outer ring portion of the toy of FIG. 1.

FIG. 9 is an enlarged view of the portion 12*a* of outer ring 12. Shown thereon in dotted lines are the three screw paths designated 54, 55 and 56. These three paths 54–56 are displaced about the circumference of the portion 12*b* at 120 degree intervals. Each screw path has thread segments which bear the same reference numeral with a letter suffix. That is, screw path 54 has thread segments 54*a* and 54*b* as illustrated; thread segment 54*a* is on screw path 54; and thread segment 55*a* is positioned along screw path 55, with thread segments 56*a* and 56*b* positioned along screw path 56. Reference numeral 60 along the laterally extending solid line depicts the junction of the two halves from which the ring assembly of the ring toy 10 is formed.

Defining the centerline of the outer ring 12 as an axial direction, as shown, moving from right to left in FIG. 9, each thread segment along its screw path overlaps an adjacent thread segment, and none of the thread segments intersect the seam or junction 60. That is, by reference to the thread segments, segment 56*a* commences at the enlarged shoulder portion 33, while thread segment 54*a* is displaced a distance therefrom, and thread segment 55*a* is displaced a greater distance therefrom with all thread segments having approximately the same axial length. Each thread segment along a given screw path is spaced end-to-end in the axial direction along this path.

Figure 7:
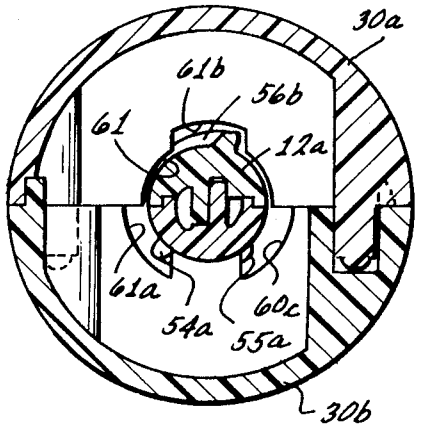
FIG. 7 is a cross-sectional view of the rotatable activity member of the toy of FIG. 1, as viewed generally along line 7—7 thereof.

By referring now to FIGS. 1 and 7, the activity FIG. 30 which coacts with the ring portion 12*a* is formed of two halves 30*a* and 30*b* which are joined with the projection and opening arrangement common to the other activity devices. In other words, all of the thread segments along a given screw path are in alignment along the screw path, with spacing between adjacent ends of adjacent thread segments on the path. Formed in the head portion of the FIG. 30 is an opening 61, with three equiangularly disposed slotted portions 61*a*, 61*b* and 61*c*, with each slotted portion configured for passage therethrough of one set of the thread segments for one of the screw paths 54–56.

As the FIG. 30 moves along the axial length of the ring portion 12*a*, the slotted portions 61*a*, 61*b* and 61*c*, each, in turn, sequentially engage a thread segment next in the path of travel, and due to the axial overlapping of the thread segments along the screw paths 54–56, at least one of the thread segments is always in engagement with one of the slots 61*a*–61*c*, thus enabling the rotational movement of the FIG. 30 in the axial direction under the force of gravity as the ring toy 10 is manipulated.

In accordance with the present invention there has been shown and described a child's activity ring toy 10 with a plurality of activity devices capable of slidable and rotational movement thereon. Although the segmented thread arrangement has been illustrated on ring portion 12*a* only, it is to be understood that such an arrangement may be conveniently employed on the other ring portion 12*b;* and further such a thread and device arrangement may be likewise formed and utilized on a straight shaft arrangement for causing helical rotation of an object during descent thereof.

While there has been shown and described a preferred embodiment, it is to be understood that various other adaptations and modifications may be made within the spirit and scope of the invention.

I claim:

1. In an activity toy, the combination comprising:

a generally tubular rod-like member configured to form a ring and having central curvilinear axis, and having along at least a portion thereof a plurality of screw paths circumferentially equally spaced thereon, each of said screw paths being formed of a plurality of outwardly extending thread segments disposed in spaced aligned relation along the axial direction of said ring member, each thread segment of a given screw path being in overlapping relation in the axial direction with a thread segment of an adjacent screw path, said ring member being formed of two ring-like halves of molded plastic joined together with all of said thread segments being fully formed on said halves on either side of the junction of said two halves; and a device having an opening with a plurality of slots formed therein, each of said slots being configured for engagement with one of said thread segments with said portion within said opening for causing rotational movement of said device during travel on said portion of said rod-like member in said axial direction, the overlap of adjacent thread segments of adjacent screw paths being such that at least one slot of said opening of said device is always in engagement with at least one of said thread segments.

2. The combination according to claim 1 wherein there are three equally spaced screw paths along said ring member.

3. The combination according to claim 2 wherein said toy has movably mounted thereon at least one other activity device.

4. In a child's activity ring toy, the combination comprising:

first and second concentric ring portions, each said ring portion having a central curvilinear axis, at least a part of at least one of said ring portions having a plurality of screw paths circumferentially equally spaced thereon, each of said screw paths being formed of a plurality of outwardly extending thread segments disposed in spaced aligned relation along the screw path in the axial direction of said at least one of said ring portions, each thread segment of a given screw path being in overlapping relation in the axial direction with a thread segment of an adjacent screw path, said at least one of said ring portions being formed of two ring-like halves of molded plastic joined together with all of said thread segments being fully formed on said halves on either side of the junction of said two halves; and a figure mounted for movement on the so-threaded part of said ring portion with an opening with a plurality of slots formed therein, each of said slots being configured for engaging one of said thread segments in the axial direction of movement with said so-threaded part of said ring portion within said opening for enabling rotational movement of said figure during axial movement on said so-threaded portion, the overlap of segments of adjacent screw paths being such that at least one slot of of said said opening of said figure is always in engagement with at least one of said thread segments.

5. The combination according to claim 4 wherein there are three screw paths and said opening in said figure has three slots spaced for engagement with said thread segments.

6. The combination according to claim 5 wherein said first and second ring portions are maintained in concentric relation by interconnecting radially extending spoke means.

7. The combination according to claim 6 wherein said thread segments are on at least a part of the outer of said concentric ring portions.

8. The combination according to claim 7 wherein a ball device is rotatably mounted within the inner of said concentric ring portions.

9. The combination according to claim 8 wherein other activity devices are rotatably mounted on said spoke means.

* * * * *